US010784058B2

(12) United States Patent
Romero

(10) Patent No.: US 10,784,058 B2
(45) Date of Patent: Sep. 22, 2020

(54) SEALED ELECTRICAL CONTACT SYSTEM

(71) Applicant: Overhead Door Corporation, Lewisville, TX (US)

(72) Inventor: Federico Romero, Corpus Christi, TX (US)

(73) Assignee: Overhead Door Corporation, Lewisville, TX (US)

( * ) Notice: Subject to any disclaimer, the term of this patent is extended or adjusted under 35 U.S.C. 154(b) by 108 days.

(21) Appl. No.: 15/589,307

(22) Filed: May 8, 2017

(65) Prior Publication Data

US 2017/0323739 A1 Nov. 9, 2017

Related U.S. Application Data

(60) Provisional application No. 62/333,605, filed on May 9, 2016.

(51) Int. Cl.
*H01H 3/16* (2006.01)
*H01H 9/04* (2006.01)

(52) U.S. Cl.
CPC ..... *H01H 3/161* (2013.01); *H01H 9/04* (2013.01); *H01H 2003/165* (2013.01)

(58) Field of Classification Search
CPC .. H01H 1/645; H01H 3/162; H01H 2231/026; H01H 2231/03
USPC ..... 200/61.62, 302.1, 51.09, 51.12, 61.7, 200/51.13, 51 R, 51.02; 439/31, 188, 439/587, 271, 278
See application file for complete search history.

(56) References Cited

U.S. PATENT DOCUMENTS 3,659,063 A * 4/1972 Peterson ..... H01H 3/162 200/61.7
3,729,603 A * 4/1973 Foltz ..... H01H 3/162 200/61.7
5,229,560 A * 7/1993 DeMarco ..... H01R 13/2421 200/61.7
5,660,566 A * 8/1997 Ohsumi ..... H01R 13/5205 439/275
7,077,676 B2 * 7/2006 Matsumoto ..... H01R 13/5205 439/271
9,954,315 B2 * 4/2018 Siebens ..... H01R 43/16

* cited by examiner

*Primary Examiner* — Edwin A. Leon
*Assistant Examiner* — Lheiren Mae A Caroc
(74) *Attorney, Agent, or Firm* — Haynes and Boone, LLP

(57) ABSTRACT

A sealed electrical contact system includes at least one male electrical contact with at least one annular flange and a male conductive contact. At least one female electrical contact includes a receptacle and a female conductive contact disposed in the receptacle. The at least one annular flange is configured to contact an inner surface of the receptacle when the male conductive contact contacts the female conductive contact and closes a circuit.

16 Claims, 5 Drawing Sheets

SEALED ELECTRICAL CONTACT SYSTEM

CROSS REFERENCE TO RELATED APPLICATION

This application claims the benefit of U.S. provisional patent application No. 62/333,605 entitled "Sealed Electrical Contact System", filed on May 9, 2016, which is incorporated herein by reference in its entirety.

TECHNICAL FIELD

The present invention relates to electrical contacts, and more particularly to electrical contacts that include features to protect the electrical contacts from debris, corrosion and moisture.

BACKGROUND

Platform screen doors are used in light and heavy railway stations to separate travelers from the trains. Platform screen doors also provide the primary ingress and egress threshold to and from the trains. Oftentimes, an automatic sliding door in the train station aligns with a corresponding sliding door of the train when the train is in position for loading and unloading. For safety reasons, when these sliding doors are open, a signal is sent to the train control center, and the train is prevented from moving. The train may only move when the platform screen doors are fully closed. In this manner, there can be no movement of the train while passengers are attempting to board or depart from the train.

If a railway system malfunctions, the railway car may enter the station but a malfunction prevents the train from aligning with the sliding doors of the platform screen door system. In this case, passengers on the train still need to exit the train, especially if there is an emergency situation on the train, such as a fire. To facilitate exit of a railway car when the train is misaligned with the sliding doors of the platform screen door system, the platform screen door is equipped with an emergency swinging door adjacent the sliding doors. In the event of an emergency with a misaligned train, the train doors open and the passengers can exit through the emergency swinging door. Oftentimes, a bar releases the emergency swinging door similar to a fire door of a building.

The emergency swinging door is equipped with an electrical sensor or switch that communicates to the train control system that the door is in a closed position, and thus, if the sliding doors are also closed and this condition is sensed by the system, then the train can move. However, if the emergency swinging door is opened, the electrical sensor sends a signal that overrides the all clear signal and prevents movement of the train. Magnetic switches are not used in connection with railways because the power lines associated with the trains create large magnetic fields that may interfere with a magnetic switch.

There are different types of electrical sensors that can provide the signal for the emergency swinging door of the platform screen door system. For example, a plunger switch or a lever switch may be used. However, if either a plunger switch or a lever switch is damaged, an electrical connection may not be made or the connection may be weak such that it may send a false signal that stops operation of the train. To make the system more robust, multiple plunger switches or multiple lever switches may be employed in parallel. Thus, if one switch fails, the other switch may continue to be operational.

Elevators sometimes employ positive operation door contacts to communicate when an elevator is in a proper position to allow opening of the elevator doors and/or the doors of the elevator lobby. In these contacts, a pair of pins is received in a pair of receptacles. If the pins are properly in position in the receptacles, an electrical signal travels from one pin to the second pin and the corresponding electrical signal communicates that the elevator is in the proper position to allow operation of the doors. K. A. Schmersal GmbH & Co. KG d/b/a Schmersal of Wuppertal, Germany provides positive-operation elevator contacts of the type described.

These pin/receptacle elevator contacts may not be as reliable when used in a railroad environment because parts of the pins may be exposed to the environment. Moisture, debris and other environmental conditions can cause part of the pins to corrode such that the electrical signal is impeded from traveling from one pin to the other. Although, this is a fail-safe type of failure mode in that breaking the electrical path with corrosion causes the system to interpret the elevator out of position and therefore not allow the doors to operate, it is still inconvenient, inefficient, and costly to investigate, repair, and/or replace the positive door contacts such that the system functions normally.

What is needed is a positive electrical contact system that has increased reliability when used in a railroad environment because it is protected from moisture and corrosion.

SUMMARY

A sealed electrical contact system includes at least one male electrical contact with at least one annular flange and a male conductive contact. At least one female electrical contact includes a receptacle and a female conductive contact disposed in the receptacle. The at least one annular flange is configured to contact an inner surface of the receptacle when the male conductive contact contacts the female conductive contact and closes a circuit.

According to one embodiment, a pair of male electrical contacts are secured to a trailing edge of a door, and a pair of female electrical contacts are secured to a door jamb. The door may rotate on an offset pivot. When the door is closed, the male electrical contact is received in the female electrical contact and respective conductive contacts are electrically coupled with each other and a circuit is closed. The female electrical contacts may be disposed at each end of an open circuit, and the male electrical contacts are electrically coupled to each other. Closing the circuit sends a signal to a train control system that the door is closed and the train may be safely operated. The annular flanges create a seal with the inner surface of the female receptacle where the seal is analogous to a seal formed by a plunger and a barrel of a syringe.

Technical advantages of the sealed electrical contact system include a prong/receptacle type electrical contact system where the conductive portions are sealed with a water-tight seal that prevents water, debris, and corrosion from interfering with the electrical coupling of the prong/receptacle type electrical contact system, which would otherwise falsely signal that an emergency door of a platform screen door system is not fully closed, and thereby prevent normal operation of a train.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of the present invention may be acquired by reference to the following Detailed Description when taken in conjunction with the accompanying Drawings wherein.

DETAILED DESCRIPTION OF THE DRAWINGS

Figure 1:
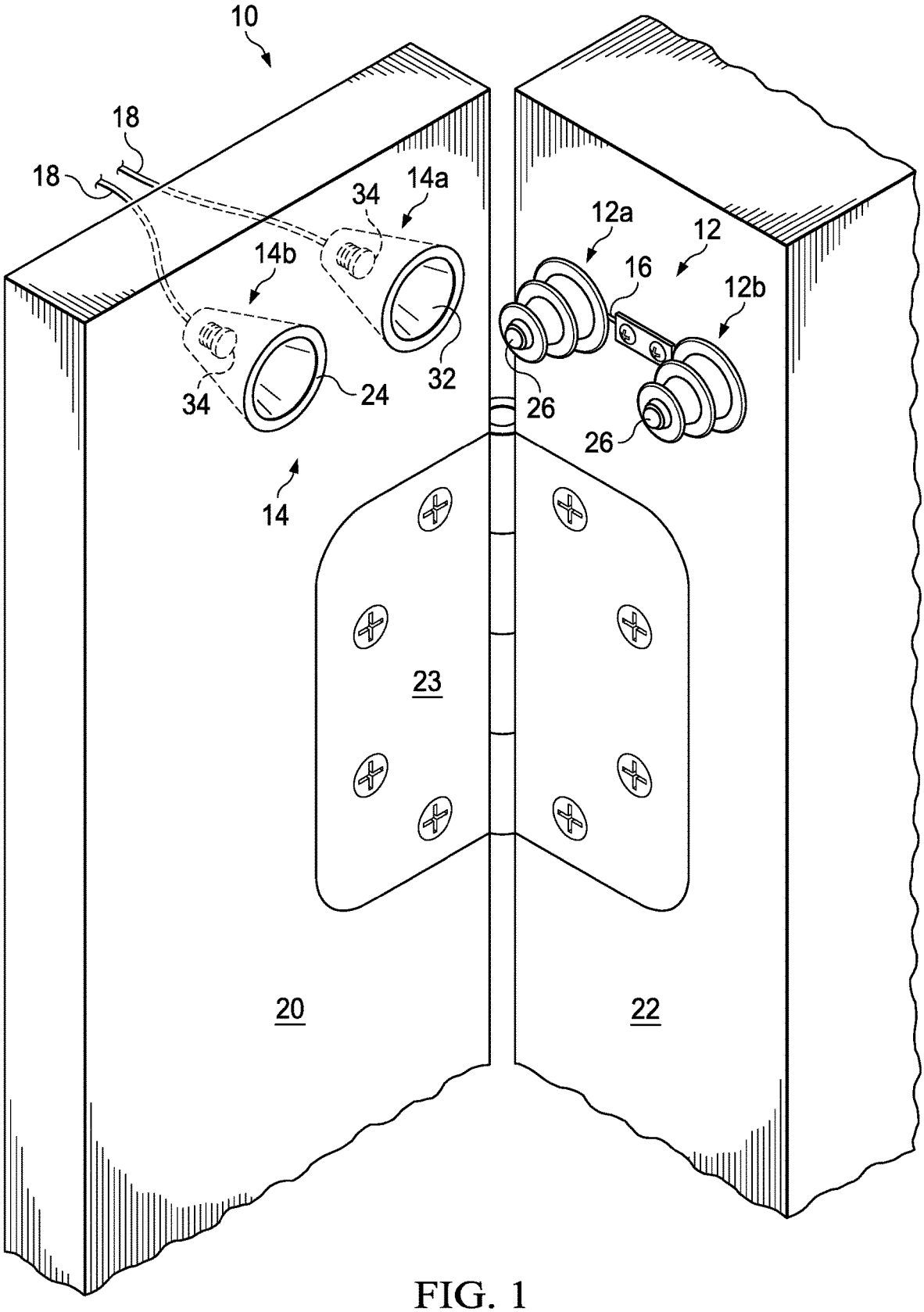
FIG. 1 is a perspective view of an environment including a sealed electrical contact system according to an embodiment of the present disclosure.

FIG. 1 is an environmental view of a sealed electrical contact system 10 where the electrical contacts are not in electrical communication which each other so the details of the respective contacts can be shown. The sealed electrical contact system 10 according to the teachings of the present disclosure is suitable for any male/female electrical contact that completes a circuit or otherwise communicates a signal. For example, the sealed electrical contact system 10 may indicate positioning of doors (i.e. whether the door is open or fully closed), such as elevator doors, sliding doors, swinging doors, and the like. The sealed electrical contact system 10 may also be used to sense the positioning of an elevator car.

According to one embodiment, the sealed electrical contact system 10 may be employed on a platform screen door. More specifically, the sealed electrical contact system 10 may be employed on an emergency swinging door of a platform screen door system. The seal created by the electrical contacts may be water tight to prevent corrosion and other debris from interfering with the electrical connection and falsely indicating that the swinging doors are open. This sealing function may be particularly beneficial in a railway environment where moisture, debris, and other unwanted material are virtually unavoidable.

The sealed electrical contact system 10 includes a pair of male electrical contacts 12 and a pair of female electrical contacts 14. A first male electrical contact 12*a* is electrically connected to a second male electrical contact 12*b* by any suitable electrically conductive means, such as a conductive wire 16. Each of the female electrical contacts 14*a* and 14*b* are ends of an open circuit, and therefore each is connected to a respective conductive wire 18 that runs within (and/or along) a door jamb 20. In certain embodiments, the conductive wires 18 are electrically coupled to a railroad control system (not illustrated). Thus, when the pair of male electrical contacts 12 are electrically coupled to the pair of female electrical contacts 14, the circuit is closed and the railroad control system receives a signal that is interpreted as indicating that an emergency swinging door 22 of the platform screen door system is closed and it is safe to operate the train, provided all other safety signals indicate the train may be safely operated, for example the signal indicating that the sliding door, which is the primary entrance and exit from the train car, is fully closed.

According to certain embodiments, the male electrical contacts 12 may be secured to either the door 22 or the door jamb 20, and the female electrical contacts are secured to either the door 22 or the door jamb 20, whichever the male electrical contacts are not secured to. The male/female electrical contacts 12, 14 may be secured to either the leading side or the trailing side of the door 22 and the corresponding leading or trailing side of the door jamb 20. FIG. 1 illustrates the male electrical contacts 12 secured to a trailing side of the door 22 proximate a hinge 23 and the female electrical contacts 14 secured to a door jamb 20. The door 22 may include an offset pivot to facilitate more direct insertion of the male electrical contact 12 into the female electrical contact 14. Other embodiments contemplate any combination of male/female electrical contacts. For example, the door 22 may include one male and one female electrical contact and the door jamb 20 may include one male and one female electrical contact, provided that when all of the electrical contacts (male/female) are in electrical communication with each other, a circuit is closed. And, when one of the four electrical contacts is not in electrical communication with the others, then the circuit is open and the door 22 is indicated as not fully closed.

The female electrical contacts 14 each include a receptacle 24. The receptacle 24 is generally frustoconically-shaped and hollow with an open distal end. In certain embodiments, the receptacle 24 may be formed of a substantially rigid polymer material and may generally be a thin-walled part. The receptacle 24 may be formed using any suitable polymer forming process, such as injection molding.

Figure 2A:
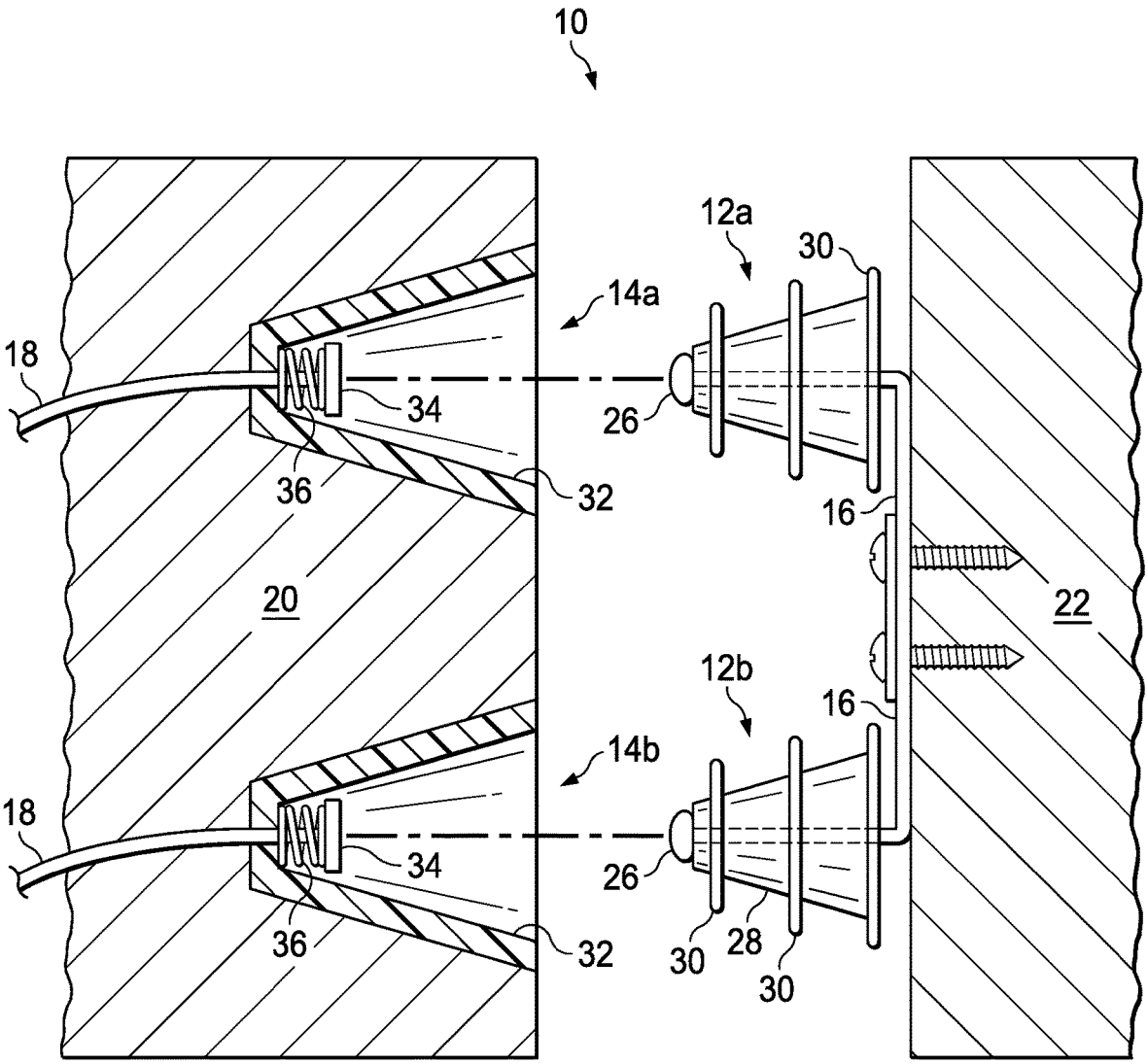
FIG. 2A is a partial section view of the sealed electrical contact system of FIG. 1 illustrating an open circuit.
Figure 2B:
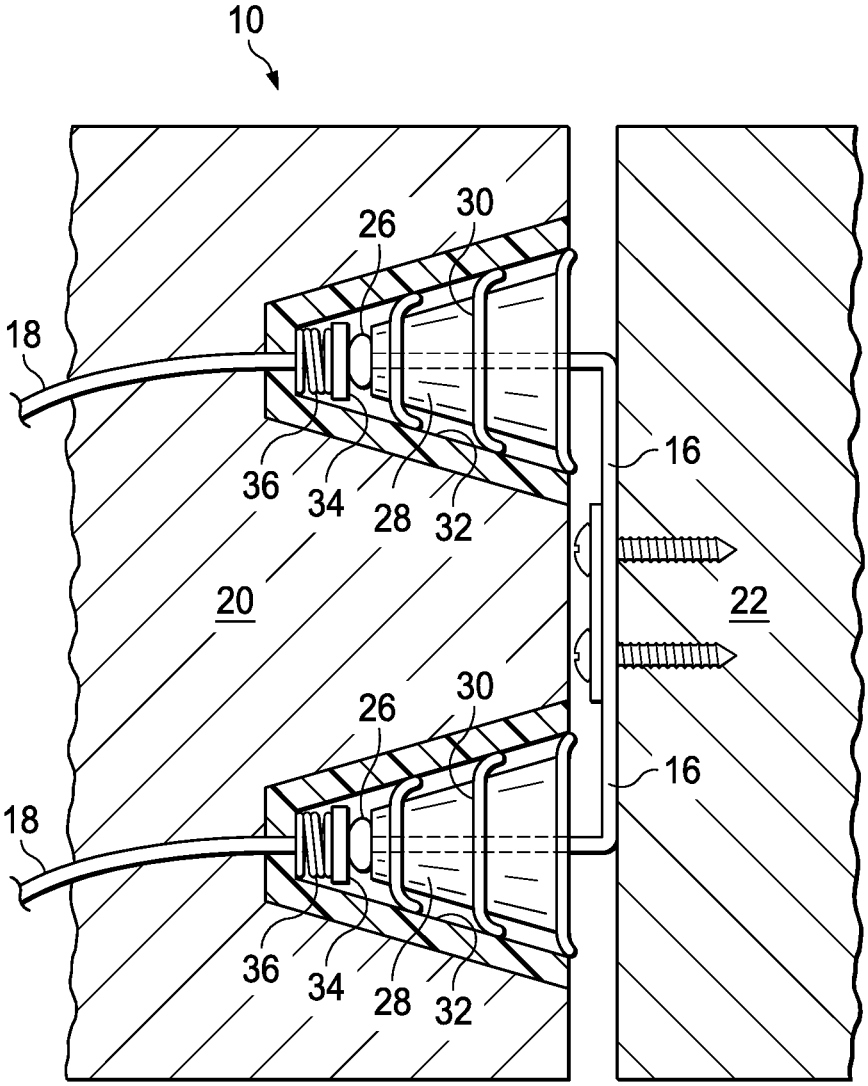
FIG. 2B is a partial section view of the sealed electrical contact system of FIG. 2A illustrating a closed circuit.

FIG. 2A is a section view of the sealed electrical contact system 10 showing an open circuit, and FIG. 2B is a section view of the sealed electrical contact system 10 showing a closed circuit. Each male electrical contact 12 includes a conductive contact 26, typically formed of metal, disposed at a distal end of the male electrical contact 12. The conductive contact 26 is electrically coupled to the wire 16, which connects to the other conductive contact 26. The wire 16 runs through a cone portion 28 of the male electrical contact 12. The cone portion 28 supports at least one and preferably a plurality of annular flanges 30, where each annular flange 30 surrounds, the cone portion 28. The cone portion 28 may be a generally rigid, thin walled part formed of a suitable polymer material, similar to the receptacle 24. According to an alternate embodiment, the cone portion 28 may be omitted and the annular flanges 30 may surround the wire 16. The annular flanges 30 are formed of a resilient material, such as natural or synthetic rubber. This disclosure is not limited to conically-shaped electrical contacts, but rather contemplates electrical contacts of any suitable shape provided a prong-shaped portion is inserted into a receptacle. For example, the male electrical contact 12 may be generally cylindrical and be inserted into a generally cylindrical, hollow female receptacle. 24.

When the male electrical contacts 12 are inserted into the female electrical contacts 14 such that the circuit is closed, as illustrated in FIG. 2B, the annular flanges 30 contact an inner surface 32 of the receptacle 24 and form a seal. The annular flanges 30 are elastically deformed by the contact with the inner surface 32 of the receptacle 24 and the resilient material of the flanges 30 opposes this elastic deformation, such that a seal is formed between the annular flanges 30 and the inner surface 32 of the rigid receptacle 24.

The seal formed is analogous to a seal formed in a syringe between the barrel and the plunger. According to certain embodiments, a diameter of the annular flanges 30 may increase from a smallest diameter proximate the conductive contact 26 to a largest diameter furthest from the conductive contact 26.

Each of the female electrical contacts 14 include a conductive contact 34, and each of these conductive contacts 34 may be coupled to a biasing element 36. The biasing element 36 may be a single piece of resilient material, such as rubber or a closed-cell foam. According to an alternate embodiment, the biasing element may be a coil spring. The biasing element 36 biases the female conductive contact 34 toward the male conductive contact 26. In this manner, manufacturing tolerances and shifting structures are accommodated. In addition, the biasing element 36 allows electrical contact and a closed circuit condition to be maintained even under vibrating conditions associated with train movement. The biasing element 36 also allows an electrical connection to be made if the male electrical contact 12 is less than fully inserted into the female electrical contact 14.

Figure 3A:
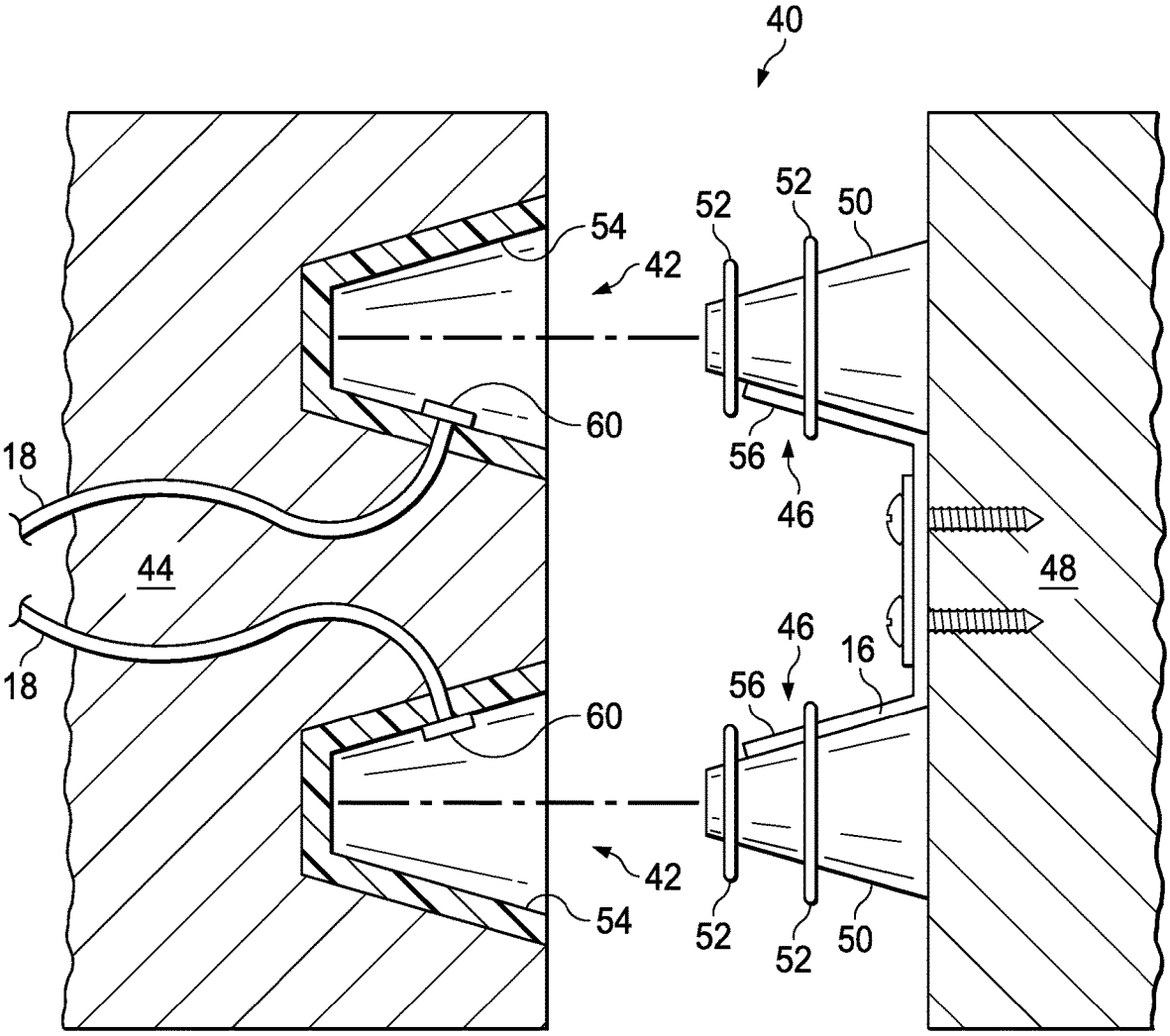
FIG. 3A is a partial section view of an alternate embodiment of a sealed electrical contact system according to the teachings of the present disclosure illustrating an open circuit.
Figure 3B:
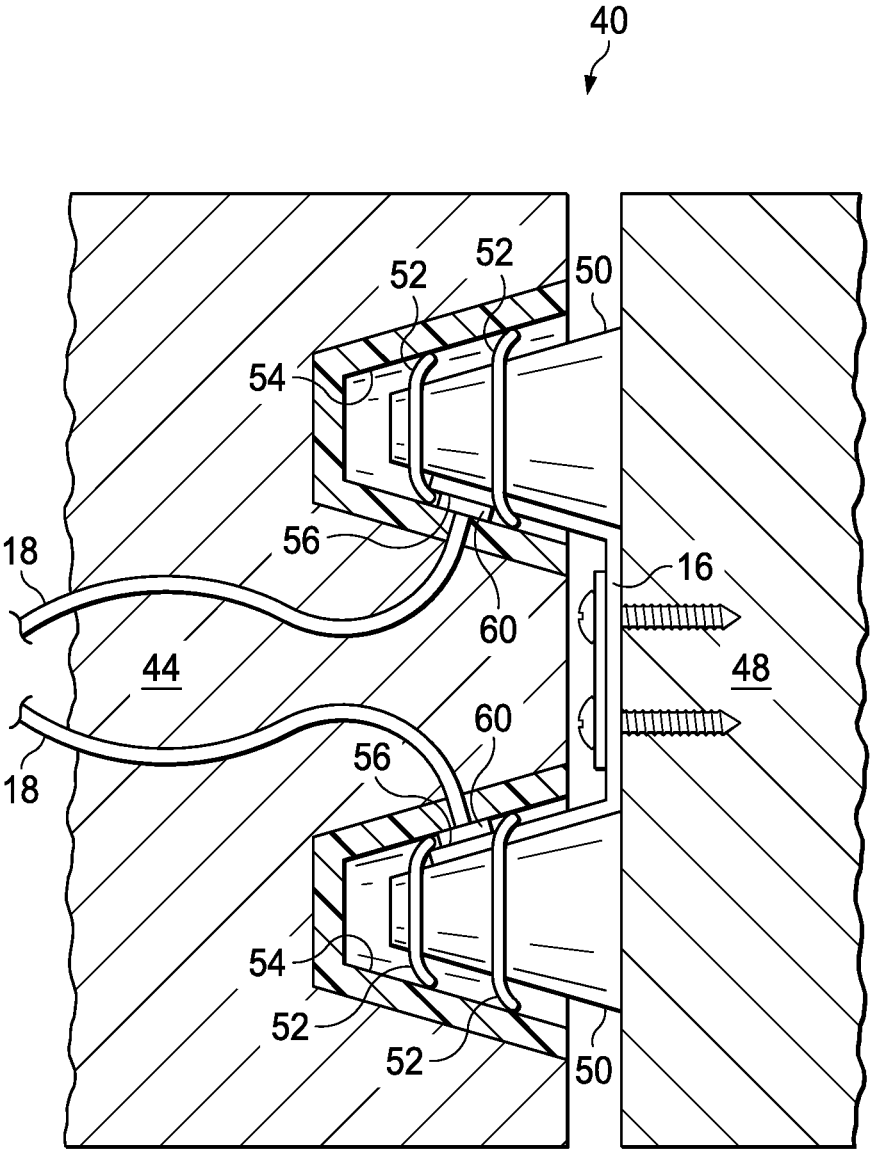
FIG. 3B is a partial section view of the electrical contact system of FIG. 3A illustrating a closed circuit.

FIG. 3A is a section view of an alternate embodiment of a sealed electrical contact system 40 showing an open circuit, and FIG. 3B is a section view of the sealed electrical contact system 40 showing a closed circuit. The electrical contact system 40 includes a pair of receptacles 42 that may be recessed into a door or a door jamb 44. The receptacles 42 receive a pair of male electrical contacts 46 to close the circuit and indicate a properly closed emergency swing door, and thus a safe condition for train operation. The pair of male electrical contacts 46 is secured to either a door 48 or the door jamb 44, as discussed above with the embodiment shown in FIGS. 1-2B. The male electrical contacts 46 include cone portion 50 that supports a plurality of annular flanges 52. The annular flanges 52 are formed of a resilient material, and when the annular flanges 52 are elastically deformed by the inner surface 54 of the receptacle 42, a water-tight seal is created, as described above with respect to sealed electrical contact system 10, and the male and female conductive contacts 56, 60 are protected from debris and corrosion.

The male conductive contact 56 is disposed on an outer conical surface of the conical portion 50. Similarly, the female conductive contact 60 is disposed on an inner conical surface of the receptacle 42. In this manner, less than full insertion of the male electrical contact 46 into the receptacle 42 of the female electrical contact will still electrically couple the contacts 56, 60 and close the circuit. In addition, positioning the male and female electrical contacts 56, 60 on respective conical surfaces allows electrical contact to be maintained even under vibrating conditions associated with train movement or shifting structural members.

Although preferred embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A sealed electrical contact system, comprising:

at least one male electrical contact including a male conductive contact, a conical portion, and at least one annular flange surrounding the conical portion; and at least one female electrical contact including a receptacle and a female conductive contact disposed in the receptacle, the receptacle being hollow and conically-shaped;

wherein the at least one annular flange is configured to contact and form a seal with an inner surface of the receptacle when the male conductive contact contacts the female conductive contact and closes a circuit.

2. The sealed electrical contact system of claim 1 wherein closing the circuit communicates a signal indicating that a swinging door of a platform screen door is closed.

3. The sealed electrical contact system of claim 1 wherein the at least one annular flange is a plurality of annular flanges.

4. The sealed electrical contact system of claim 3 wherein each one of the plurality of annular flanges has a different diameter.

5. The sealed electrical contact system of claim 1 wherein the female electrical contact further includes a biasing element to bias the female conductive contact toward contact with the male conductive contact.

6. The sealed electrical contact system of claim 5 wherein the biasing element comprises a resilient material.

7. The sealed electrical contact system of claim 1 wherein the at least one male electrical contact comprises a first male electrical contact and a second male electrical contact and wherein the first male electrical contact is electrically coupled to the second male electrical contact.

8. The sealed electrical contact system of claim 1 wherein the female conductive contact is disposed on a sloped inner surface of the receptacle.

9. The sealed electrical contact system of claim 1 wherein the at least one annular flange is formed of a resilient material.

10. The sealed electrical contact system of claim 1 wherein the male electrical contact is coupled to one of a portion of a door or a door jamb and the female electrical contact is coupled to the other of the portion of the door or the door jamb.

11. The sealed electrical contact system of claim 10 wherein the portion of the door is at a leading side of the door.

12. The sealed electrical contact system of claim 10 wherein the portion of the door is at a trailing side of the door.

13. The sealed electrical contact system of claim 10 wherein the receptacle is recessed in the other of the portion of the door or the door jamb.

14. A sealed electrical contact system, comprising:

a first male electrical contact and a second male electrical contact each including at least one annular flange, a first male conductive contact of the first male electrical contact being electrically coupled to a second male conductive contact of the second male electrical contact; and a first female electrical contact and a second female electrical contact, the first female electrical contact including a first receptacle and a first female conductive contact disposed within the first receptacle, the second female electrical contact including a second receptacle and a second female conductive contact disposed within the second receptacle;

wherein each of the at least one annular flanges is configured to contact an inner surface of and form a seal with the respective first and second receptacles when the first male conductive contact contacts the first female conductive contact and the second male conductive contact contacts the second female conductive contact.

15. The sealed electrical contact system of claim 14 wherein each of the at least one annular flanges is formed of a resilient material.

16. The sealed electrical contact system of claim 14 wherein the first and second male electrical contacts are secured to one of a portion of a door or a door jamb and the first and second female electrical contacts are secured to the other of the portion of the door or the door jamb.

* * * * *